US009021637B1

(12) United States Patent
Whelan et al.

(10) Patent No.: US 9,021,637 B1
(45) Date of Patent: May 5, 2015

(54) WHEELCHAIR CUSHION WITH ADJUSTABLE/MULTI-STIFFNESS FLUID

(71) Applicants: Thomas J Whelan, Longmont, CO (US); Stephen Sprigle, Marietta, GA (US); Alison McKenna, Rochester, NY (US); Ezekiel Kolajo, Carrollton, GA (US); Sanchit Mittal, Atlanta, GA (US); Saranya Sathananthan, Brentwood, TN (US); Christopher Tile, Carthage, NC (US)

(72) Inventors: Thomas J Whelan, Longmont, CO (US); Stephen Sprigle, Marietta, GA (US); Alison McKenna, Rochester, NY (US); Ezekiel Kolajo, Carrollton, GA (US); Sanchit Mittal, Atlanta, GA (US); Saranya Sathananthan, Brentwood, TN (US); Christopher Tile, Carthage, NC (US)

(73) Assignee: Ki Mobility, Stevens Point, WI (US)

( * ) Notice: Subject to any disclaimer, the term of this patent is extended or adjusted under 35 U.S.C. 154(b) by 0 days.

(21) Appl. No.: 13/932,218

(22) Filed: Jul. 1, 2013

Related U.S. Application Data

(60) Provisional application No. 61/666,319, filed on Jun. 29, 2012.

(51) Int. Cl.

| | |
|---|---|
| ***A47C 20/04*** | (2006.01) |
| ***A47C 7/02*** | (2006.01) |
| ***A61G 5/10*** | (2006.01) |

(52) U.S. Cl.
CPC ..... *A61G 5/1043* (2013.01)

(58) Field of Classification Search
USPC ..... 5/655.5, 654, 655.2, 655.3, 655.4, 739, 5/710, 711, 712, 713, 653, 437; 297/219.1, 411.36, 452.1, 452.13, 297/452.21, 452.25, 452.26, 452.29
See application file for complete search history.

(56) References Cited

U.S. PATENT DOCUMENTS

| | | | | |
|---|---|---|---|---|
| 5,378,045 | A * | 1/1995 | Siekman et al. | 297/452.25 |
| 5,390,384 | A * | 2/1995 | Dinsmoor et al. | 5/654 |
| 5,395,162 | A * | 3/1995 | Jay et al. | 297/452.25 |
| 5,490,299 | A * | 2/1996 | Dinsmoor et al. | 5/654 |
| 5,797,155 | A * | 8/1998 | Maier et al. | 5/654 |
| 5,829,081 | A * | 11/1998 | Pearce | 5/654 |
| 5,836,654 | A * | 11/1998 | DeBellis et al. | 297/452.41 |
| 5,857,749 | A * | 1/1999 | DeBellis et al. | 297/452.41 |
| 7,216,388 | B2 * | 5/2007 | Bieganek et al. | 5/653 |
| 7,373,678 | B2 * | 5/2008 | Hetzel et al. | 5/653 |
| 7,614,704 | B2 * | 11/2009 | Whelan et al. | 297/452.25 |
| 2002/0108179 | A1 * | 8/2002 | Kiser | 5/654 |

* cited by examiner

*Primary Examiner* — Peter M Cuomo
*Assistant Examiner* — Brittany Wilson
(74) *Attorney, Agent, or Firm* — Thedford I. Hitaffer; Hitaffer & Hitaffer, PLLC

(57) ABSTRACT

A wheelchair cushion comprises a dual stiffness fluid. A cushion also comprises an ability to adjust fluid volume.

9 Claims, 5 Drawing Sheets

WHEELCHAIR CUSHION WITH ADJUSTABLE/MULTI-STIFFNESS FLUID

CROSS-REFERENCE TO RELATED APPLICATIONS

This application claims the benefit of U.S. Provisional Application No. 61/666,319, filed Jun. 29, 2012, the disclosure of which is incorporated herein by reference

BACKGROUND OF THE INVENTION

This invention relates in general to cushions and more particularly to wheelchair cushions that are structured to redistribute load under tissues that support the bony prominences of the pelvis, such as the ischial tuberosities and the trochanters.

Wheelchair cushions that redistribute load are beneficial to users who are at risk of developing pressure ulcers due to prolonged sitting. In addition to redistributing pressure, wheelchair cushions should provide a stable base for sitting. This is particularly true for users who have compromised trunk stability due to neuromuscular deficits.

Wheelchair cushions use foam and other compressible materials to distribute pressure by compressing and therefore increasing the area over which the load is distributed. Many cushions have been developed that have varying stiffness of compressible materials, specifically foam. As an example, a cushion may be designed with softer material under the ischia and firmer material under the trochanters. The softer material compresses to allow the ischia to immerse, thereby allowing the trochanters to bear load. The firmer material does not compress as easily, so that when the user leans laterally, the material will resist compression and provide stability.

Another design of wheelchair cushions uses fluid, contained in a bladder, that is displaced under load. Fluid cushions are designed to allow the fluid to flow in response to loading. The natural movement of fluid results in flow from areas of high load to areas of lower load. Cushions use design elements to manage and control the flow in order to maintain a stable sitting base. For example, when a user leans to one side, the fluid would rapidly flow away from the increased load and create instability. The design of some fluid cushions is such that this flow is restricted. For example, a cushion that uses air as the fluid may restrict the flow of air between cells to increase the time required to flow from cell to cell. As a result, when a user leans to the left or right, the air does not immediately move away from the increased load, which would cause instability. Other cushions use specialty fluids that will flow gradually in response to pressure, but retain their shape and position in the absence of pressure. Again, by restricting flow over time, the cushions can improve stability.

In general, the market sees well-designed fluid cushions as superior to well-designed foam cushions. While foam cushions rely on deflection and compression to relieve pressure on the ischia, fluid cushions allow for fluid displacement and hydrostatic loading. This is advantageous for multiple reasons. First, in general, well-designed fluid cushions retain supportive properties over time, compared to foam cushions, which gradually break down. Second, there is less shear stress on the skin tissue while displacing fluid than while deflecting foam. Last, as mentioned previously, viscous, non-Newtonian fluids maintain their position in the absence of pressure and create more stability for the user.

SUMMARY OF THE INVENTION

This invention relates to a fluid-filled wheelchair cushion comprising a dual stiffness fluid. A cushion also comprises an ability to adjust fluid volume.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
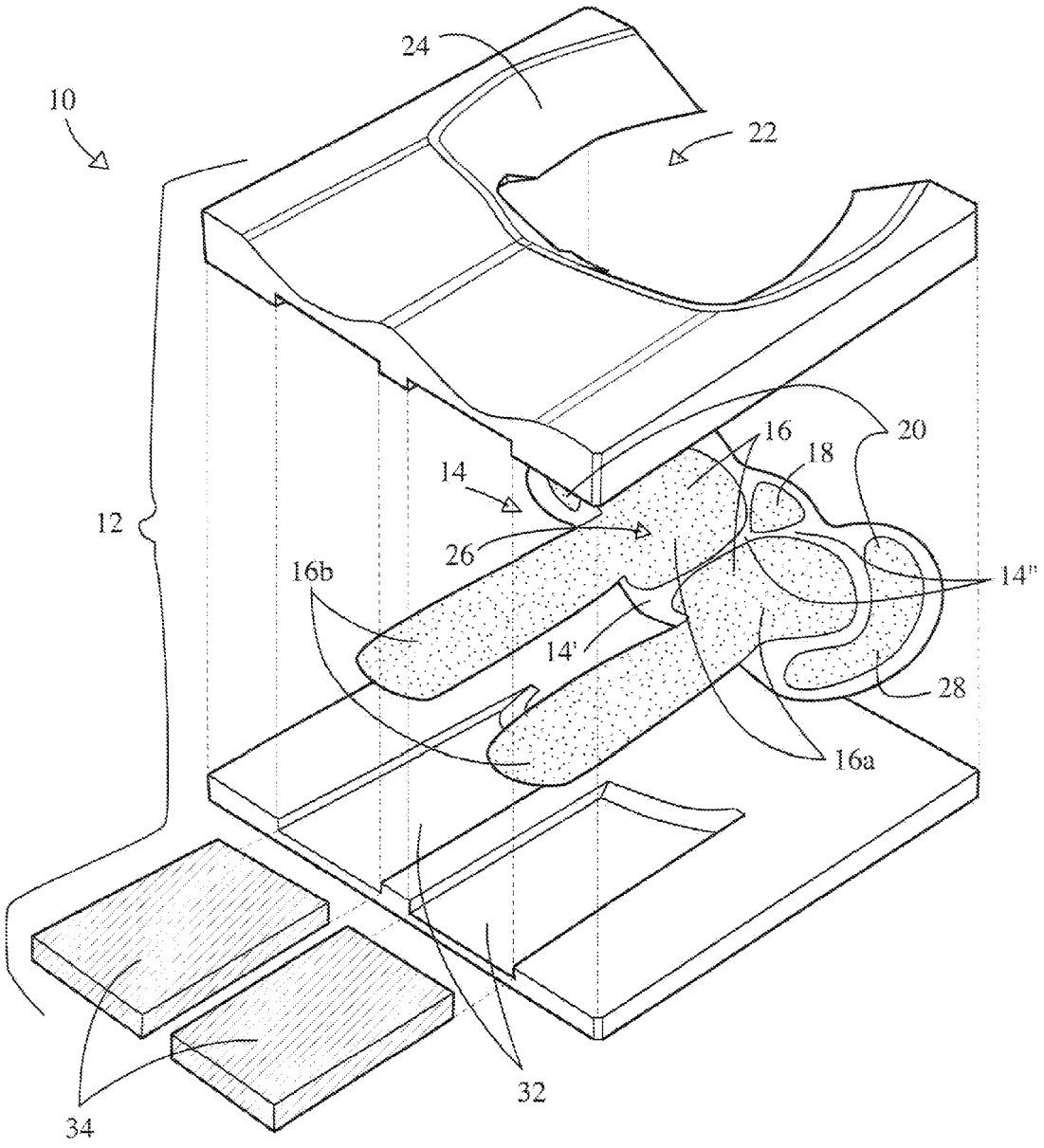
FIG. 1 is an exploded view of a wheelchair cushion.
Figure 2:
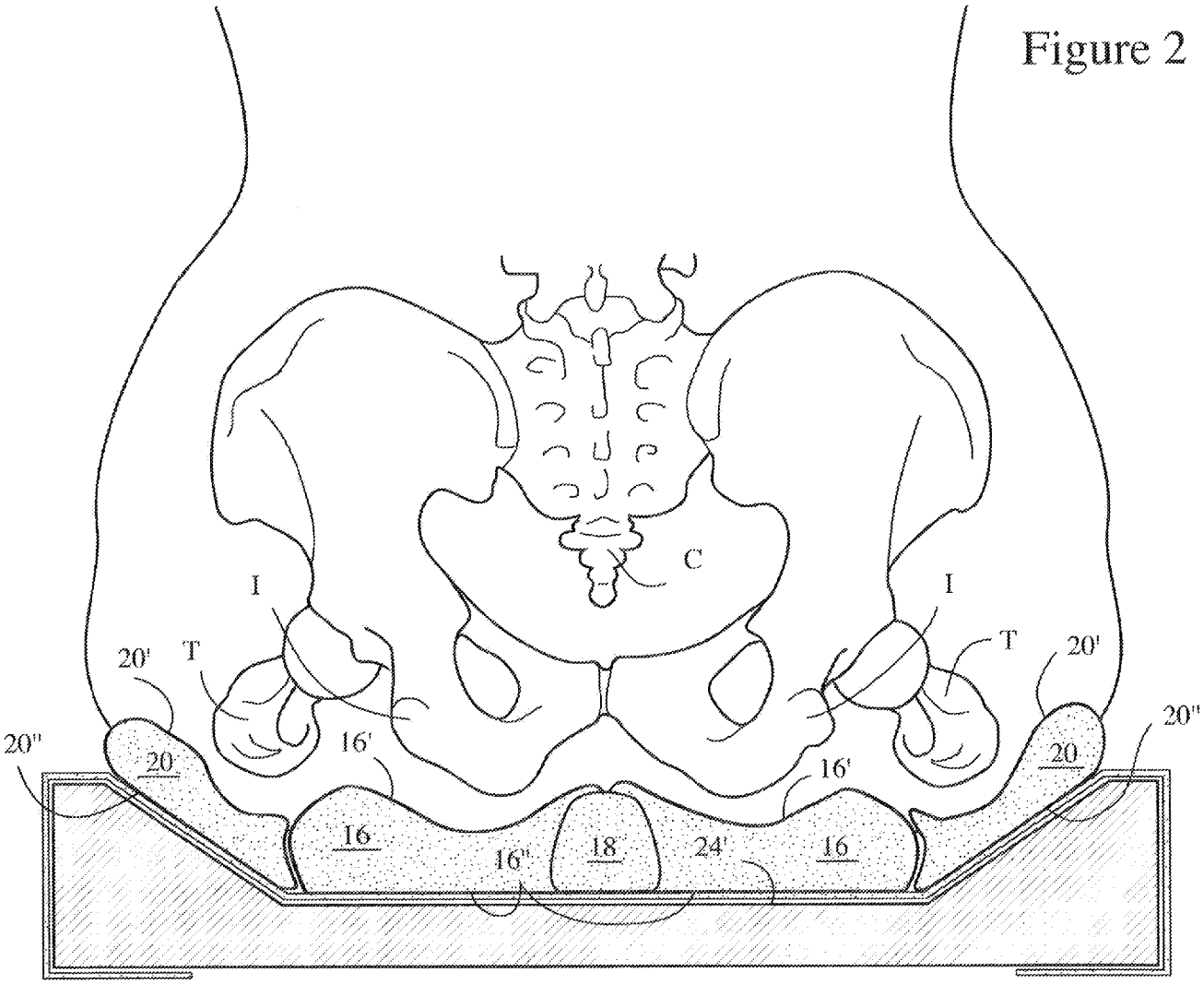
FIG. 2 is a diagrammatic sectional view of the cushion supporting a user.

Referring now to the drawings, there is illustrated in FIGS. 1 and 2 a wheelchair cushion 10 comprising a base 12 and a bladder assembly 14. The base 12 may be a structural foam base, which may be contoured (i.e., based on measurements of the user's anatomy). The bladder assembly 14 may be at least partially fluid filled, for example, by providing multiple bladders or envelops 16, 18 and 20 for receiving fluid.

The base 12 may be formed from rigid foam that is substantially incompressible (e.g., does not compress under the weight of the user), and which is substantially impervious to moisture (i.e., does not absorb moisture). An example of a suitable foam material would be polyolefin foam with a density of 300 lbs/ft$^2$. One such foam is sold under the trademark OleTex Cross Linked Olefin Foams by Armacell. The structural base may be comprised of laminated foam with a well or recess 22, formed by a dished out portion, or contour cut out of it. The well defines the pelvic loading area. The dimensions of the well are defined by pelvic anthropometry. The fluid-filled bladders 16, 18 and 20 fit into the well 22, contained by perimeter walls 24, and aid in the immersion and envelopment of the user's pelvis.

The bladders 16, 18 and 20 should prevent hammocking, a condition in which the bony prominences of the pelvis immerse into the bladder, but are not enveloped. This creates uneven pressure distribution and pulls the skin tissue into tension. The risk of hammocking can be reduced by providing a top surface 16' and 20' of the bladder 16 and 20 that is larger than the bottom surface 16" and 20" so excess material of the top surface 16' and 20' can conform to the curves of the user's body, or by using a stretchable material for the top surface 16' and 20' that will also conform. An example of an acceptable extensible (i.e., stretchable) material would be elastomeric polyurethane sheeting. A portion of the bladder assembly 14 which supports the ischia I may be split at 14' into two bladders 16, one for each ischial tuberosity. This permits fluid to be concentrated under the areas of high load, and also prevents fluid from flowing from underneath one ischium I to the other, leaving one to bottom out and the other with too much fluid. This split can also enable customization for users who may naturally exert more pressure on one ischium I than the other and would need different fill volumes in each area. Separate splits indicated at 14" in the bladder assembly 14 may form a separate bladder 20 for the coccyx C.

The fluid inside the bladder assembly 14 could be any fluid material. A viscous, thixotropic material is suitable. An example of an acceptable material would be a commercially available viscous fluid sold under the trademark Skwoosh by I-Tek Inc. The performance of Skwoosh is not easily altered by fluctuations in temperature, and it is approximately 75% lighter than the fluids most commonly used in commercially available fluid wheelchair cushions.

The cushion 10 may utilize a bladder assembly 14 with a plurality of bladders 16, 18 and 20. These bladders 16, 18 and 20 may be divided into regions or zones that are filled with different viscosities of fluid. A first region, generally indicated at 26, may encompass central bladders 16 and 18 located on the base of the well 22. Three bladders 16 and 18 may be provided for supporting the ischia I and the coccyx C. The first region 26 may be comprised of a lower viscosity fluid to facilitate immersion and envelopment of the ischia I. A second region, generally indicated at 28, is comprised of the two lateral bladders 20 located on the outside lateral sides of the bladder assembly 14. The second region 28 is comprised of a higher viscosity fluid to provide more support to the greater trochanters T as they bear load. These two bladder regions 26, 28 support the bony prominences of the load-bearing pelvis. The first region 26 is designed to allow the ischia I to immerse, thereby allowing the more viscous second region 28 to support the trochanters T and redistribute the load laterally away from the ischia I, creating a substantially even distribution of pressure.

An exemplary cushion may comprise, for example, a Skwoosh fluid with a density of 0.24 g/cm$^3$ as a higher viscosity in the first region and a Skwoosh fluid with a density of 0.22 g/cm$^3$ as a lower viscosity fluid in the second region. The two viscosities can also be adjusted to be more or less viscous depending on the user's needs.

The dual density fluids allow for increased lateral stability for the user, without compromising the ability of the ischia to immerse easily. The ischia immerse in the less viscous fluid just enough to load the trochanters on the lateral bladders with the higher viscosity fluid. The trochanters are enveloped, but encounter higher resistance to movement, strengthening the stability of the user.

The cushion 10 is structured to permit adjustment in the fluid volume ischia support bladders 16 in the first region 26 of the bladder assembly 14. Adjusting the volume of fluid in these bladders 16 may be desirable to accommodate the needs of different users. For example, some users have less soft tissue than others, creating areas of high concentrations of pressure in the buttock region. The amount of fluid the user sits on must be enough to immerse the pelvis, but not cause the user to bottom out. Changing the amount of fluid the user sits on changes the fluid pressure in the bladder so it can match the pressure exerted by the body and hydrostatically load the user. The optimal amount of fluid for a user depends on a variety of factors, including the user's body mass, pelvic structure and amount of soft tissue in the buttocks region. Current products approach fluid adjustability in multiple ways.

Figure 3:
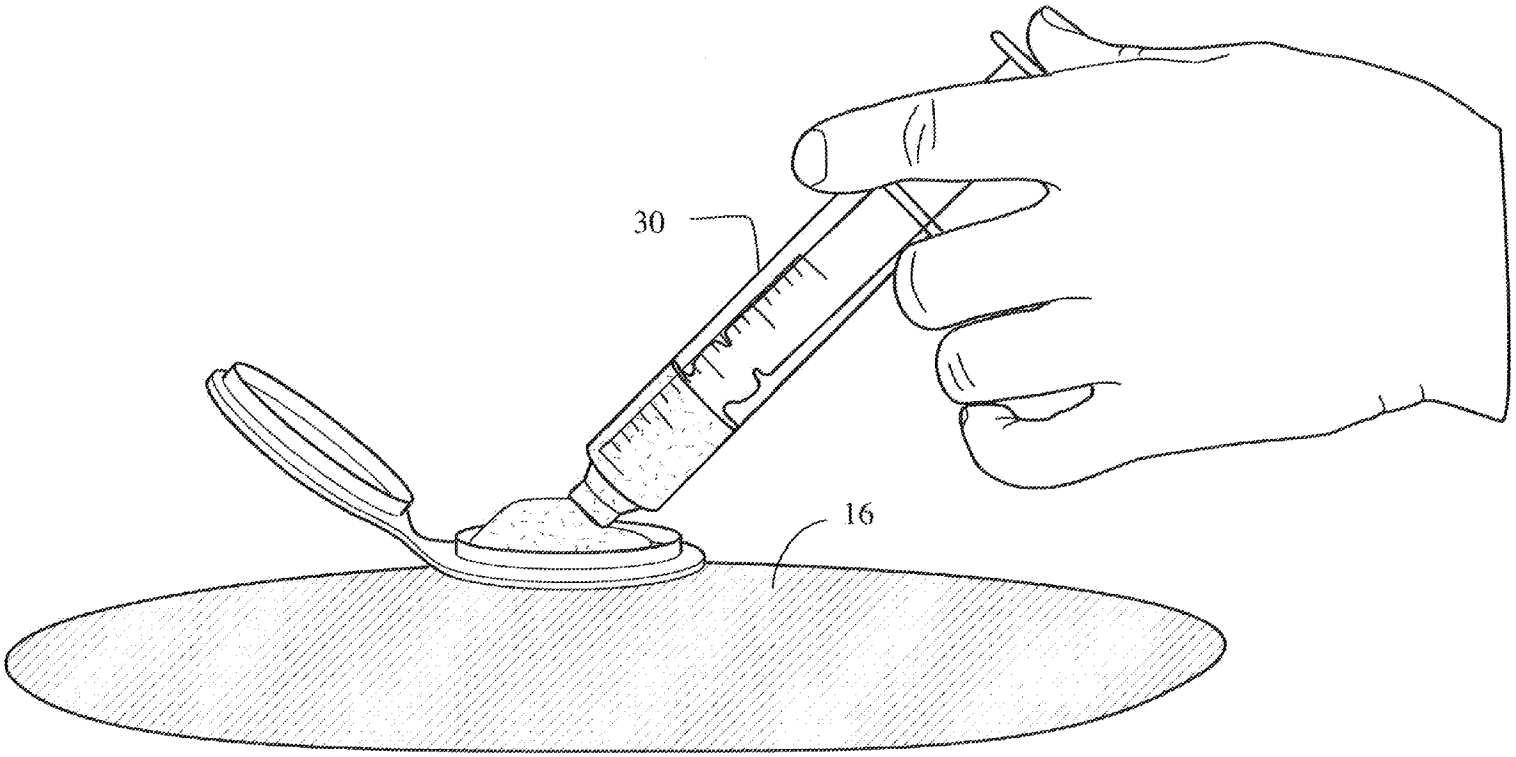
FIG. 3 is a tool for adjusting fluid in the cushion.

Fluid adjustment can be accomplished through the use of an external and/or internal reservoir. An external reservoir may be in the form of a tool that could transfer fluid between the reservoir and the first region of the bladder assembly 14. This could be done in specific measured amounts. An example of an acceptable tool would be a large screw and pump syringe, such as the syringe 30 shown in FIG. 3. The bladders 16 may have a valve or seal that could accept fluid as well as keep the bladder 16 vacuum sealed. A vacuum seal cap, like those sold under the trademark Space Bag by Illinois Tool Works would be an example of an acceptable seal. The valve or seal used may be sufficiently large or gross (i.e., not fine). This permits fluids used in the bladders 16 that degrade under the high pressure (if squeezed through a small orifice) to be substantially unaffected.

An internal reservoir may be more logistically simple for the user and the manufacturer. In an exemplary cushion 10, the bladders 16 may be subdivided into two segments. A first segment 16*a* may be a portion of the bladder 16 upon which the user sits. A second segment 16*b* of the bladder 16 is a reservoir that extends into channels 32 in the foam cushion base 12, beneath the thigh area. Fluid adjustability is accomplished through controlling the fluid flow between the first and second segments 16*a* and 16*b*.

Figure 4:
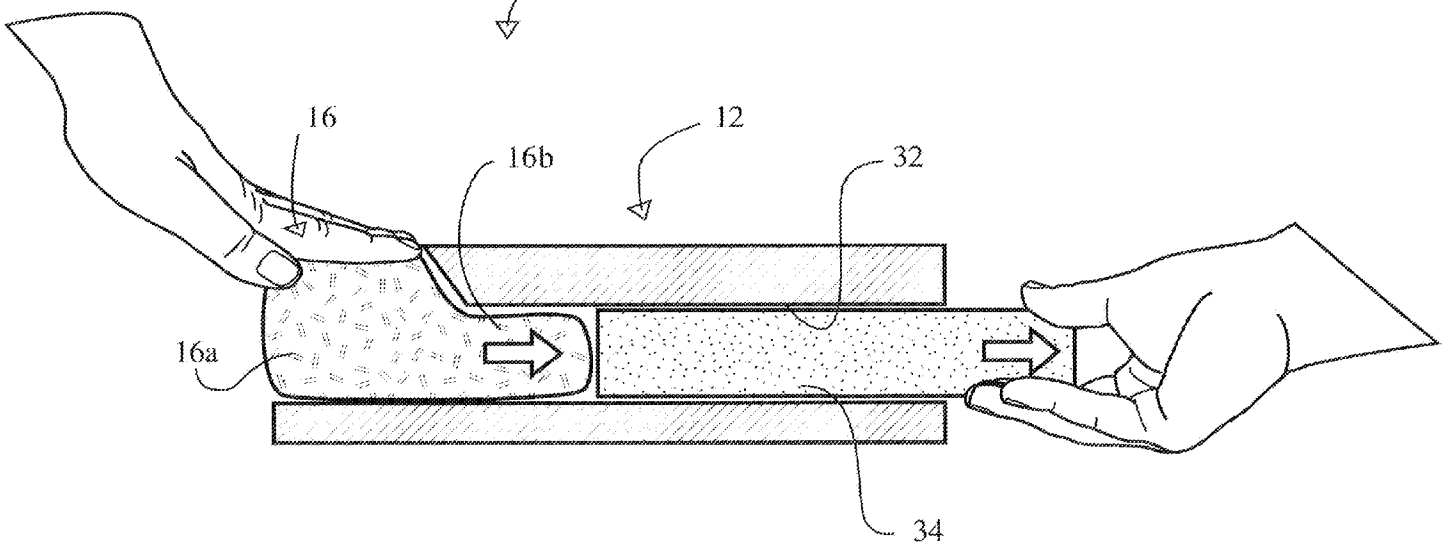
FIG. 4 is a manner for adjusting fluid in a segment of the cushion.
Figure 5:
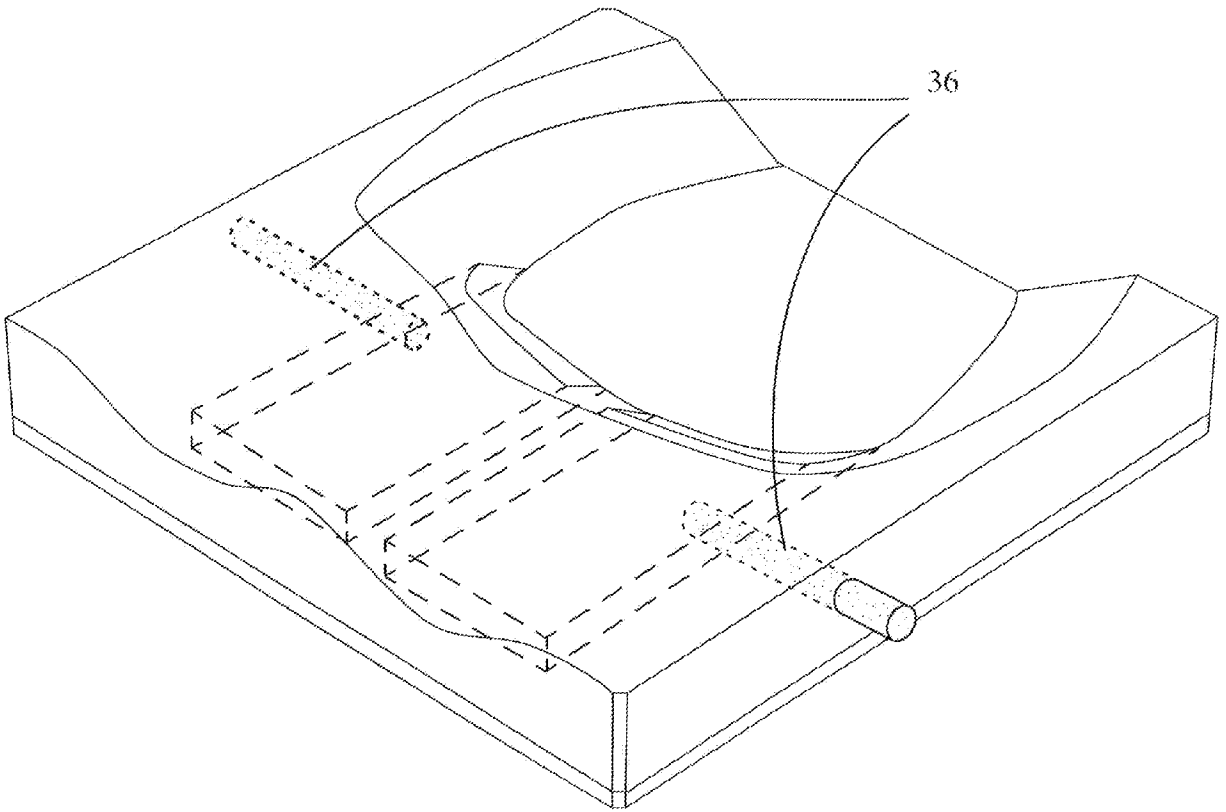
FIG. 5 is a manner for adjusting fluid in a segment of the cushion.

The fluid volume in the first segment may be controlled in any suitable manner. For example, a variable sized reservoir may be created in the channels 32 in the foam base 12. A suitable approach to varying the size of the reservoir would be to use extracted foam from channels 32 in the foam base 12 to create plugs 34 that can be reinserted into the channels 32. The extent of the insertion of the plugs 34 (as shown in FIG. 4) determines the length of the channels 32, which in turn may control how much fluid can flow into the second segment 16*b*. Another manner in which fluid volume may be controlled is by creating a seal between the first segment 16*a* and the second segment 16*b*. As an example, a small pin 36 (shown in FIG. 5) could be inserted in the side of the foam base 12, perpendicular to the transition between the two segments 16*a* and 16*b*. The pins 36 would pinch the bladders 16 so no fluid could flow between the different segments 16*a*, 16*b*. Another manner in which fluid volume may be controlled is by using a reusable, re-sealable zipper or closure as used on storage bags sold under the tradename Ziplock by SC Johnson & Son. The closure (not shown) could be situated between the two segments 16*a* and 16*b* so that it could be opened in order to transfer fluid, and closed to prevent the fluid from flowing.

In accordance with the provisions of the patent statutes, the principle and mode of operation of this invention have been explained and illustrated in an exemplary embodiment. However, it must be understood that this invention may be practiced otherwise than as specifically explained and illustrated without departing from its spirit or scope.

What is claimed is:

1. A wheelchair cushion comprising:

a base, and a bladder assembly having a plurality of bladders divided into regions that are filled with different viscosities of fluid, wherein a first region encompasses three bladders, two bladders configured to support a user's ischia and one bladder configured to support the user's coccyx, and a second region comprising two lateral bladders located on lateral sides of the bladder assembly to support the user's greater trochanters, wherein fluid volume in the ischia supporting bladders in the first region of the bladder assembly is adjustable to accommodate needs of different users, wherein fluid pressure in the ischia supporting bladders is adjustable so the fluid pressure can match pressure exerted by the user and hydrostatically load the user, wherein the fluid pressure is adjustable through the use of a reservoir, and wherein the reservoir is an external reservoir and a tool transfers fluid between the reservoir and the ischia supporting bladders.

2. The cushion of claim 1, wherein the tool is selected from a group of tools consisting essentially of a large screw syringe and a pump syringe.

3. The cushion of claim 1, wherein the ischia supporting bladders have a valve that selectively accepts fluid and keeps the bladders vacuum sealed.

4. A wheelchair cushion comprising:

a base, and a bladder assembly having a plurality of bladders divided into regions that are filled with different viscosities of fluid, wherein a first region encompasses three bladders, two bladders configured to support a user's ischia and one bladder configured to support the user's coccyx, and a second region comprising two lateral bladders located on lateral sides of the bladder assembly to support the user's greater trochanters, wherein fluid volume in the ischia supporting bladders in the first region of the bladder assembly is adjustable to accommodate needs of different users, wherein fluid pressure in the ischia supporting bladders is adjustable so the fluid pressure can match pressure exerted by the user and hydrostatically load the user, wherein the fluid pressure is adjustable through the use of a reservoir, and wherein the reservoir is a plurality of internal reservoirs, wherein the ischial supporting bladders are subdivided into two segments, a first segment being a portion of the bladders upon which a user sits and second segment being an internal reservoir that extends into channels in the foam cushion base, beneath the thigh area, and wherein fluid adjustability is accomplished through controlling the fluid flow between the first and second segments.

5. The cushion of claim 4, wherein a fluid volume in the first segment is controlled by varying the size of the internal reservoir in the channels in the foam base.

6. The cushion of claim 5, wherein the size of each of the internal reservoirs is varied by using foam extracted from the channels in the foam base to create plugs that are reinserted into the channels, whereby the extent of the insertion of the plugs determines the length of the channels, which in turn controls how much fluid can flow into the second segment.

7. The cushion of claim 4, wherein a fluid volume in the first segment is controlled by creating a seal between the first segment and the second segment.

8. The cushion of claim 7, wherein the seal is created by inserting a small pin in each side of the foam base, perpendicular to the transition between the two segments of each one of the bladders, whereby the pins pinch the bladders so no fluid flows between the two segments.

9. The cushion of claim 7, wherein the seal is created by a reusable, re-sealable zipper or closure situated between the two segments so that it opens in order to transfer fluid and closes to prevent the fluid from flowing.

* * * * *